US008888898B1

(12) United States Patent
Rice et al.

(10) Patent No.: US 8,888,898 B1
(45) Date of Patent: Nov. 18, 2014

(54) VACUUM FILLING AND DEGASIFICATION SYSTEM

(75) Inventors: Jeremy Rice, San Jose, CA (US); Jeffrey Spaulding, Sunnyvale, CA (US)

(73) Assignee: Google Inc., Mountain View, CA (US)

( * ) Notice: Subject to any disclaimer, the term of this patent is extended or adjusted under 35 U.S.C. 154(b) by 287 days.

(21) Appl. No.: 13/561,780

(22) Filed: Jul. 30, 2012

(51) Int. Cl.
*B01D 19/00* (2006.01)

(52) U.S. Cl.
USPC ..... 95/258; 95/266; 95/260; 96/218; 96/217; 96/196; 96/201; 62/85

(58) Field of Classification Search
CPC ..... B01D 19/00; B01D 19/0036; B01D 19/0052; B01D 19/0073; F25B 43/04; F28D 2021/0028
USPC ..... 95/266, 260, 241, 258; 96/218, 217, 96/193, 196, 201; 62/85
See application file for complete search history.

(56) References Cited

U.S. PATENT DOCUMENTS 3,050,798 A 8/1962 Chambers
3,226,102 A 12/1965 Pagonis
3,494,101 A 2/1970 Wikdahl
4,470,358 A 9/1984 Prochnow
4,602,923 A 7/1986 Bernstein
4,647,425 A 3/1987 Battaglia et al.
4,846,265 A 7/1989 Broglio
5,535,595 A * 7/1996 Manz ..... 62/85
5,976,226 A 11/1999 Bastian et al.
6,207,308 B1 3/2001 Grasso et al.
6,207,309 B1 3/2001 Bonville et al.
2007/0193285 A1* 8/2007 Knight et al. ..... 62/126
2007/0193721 A1* 8/2007 Tilton et al. ..... 165/104.19
2013/0233521 A1* 9/2013 Uchida et al. ..... 165/104.26

* cited by examiner

*Primary Examiner* — Duane Smith
*Assistant Examiner* — Douglas Theisen
(74) *Attorney, Agent, or Firm* — Fish & Richardson P.C.

(57) ABSTRACT

A two-phase working fluid, having a liquid phase and a gas phase, is purged of non-condensable gas prior to being used to charge a closed thermal management system, improving the heat transfer performance of the thermal management system. The liquid phase of the two-phase working fluid is exposed to conditions that cause non-condensable gas to separate from the two-phase working fluid. The non-condensable gas is vented, and two-phase working fluid that vaporizes under the conditions is captured.

30 Claims, 8 Drawing Sheets

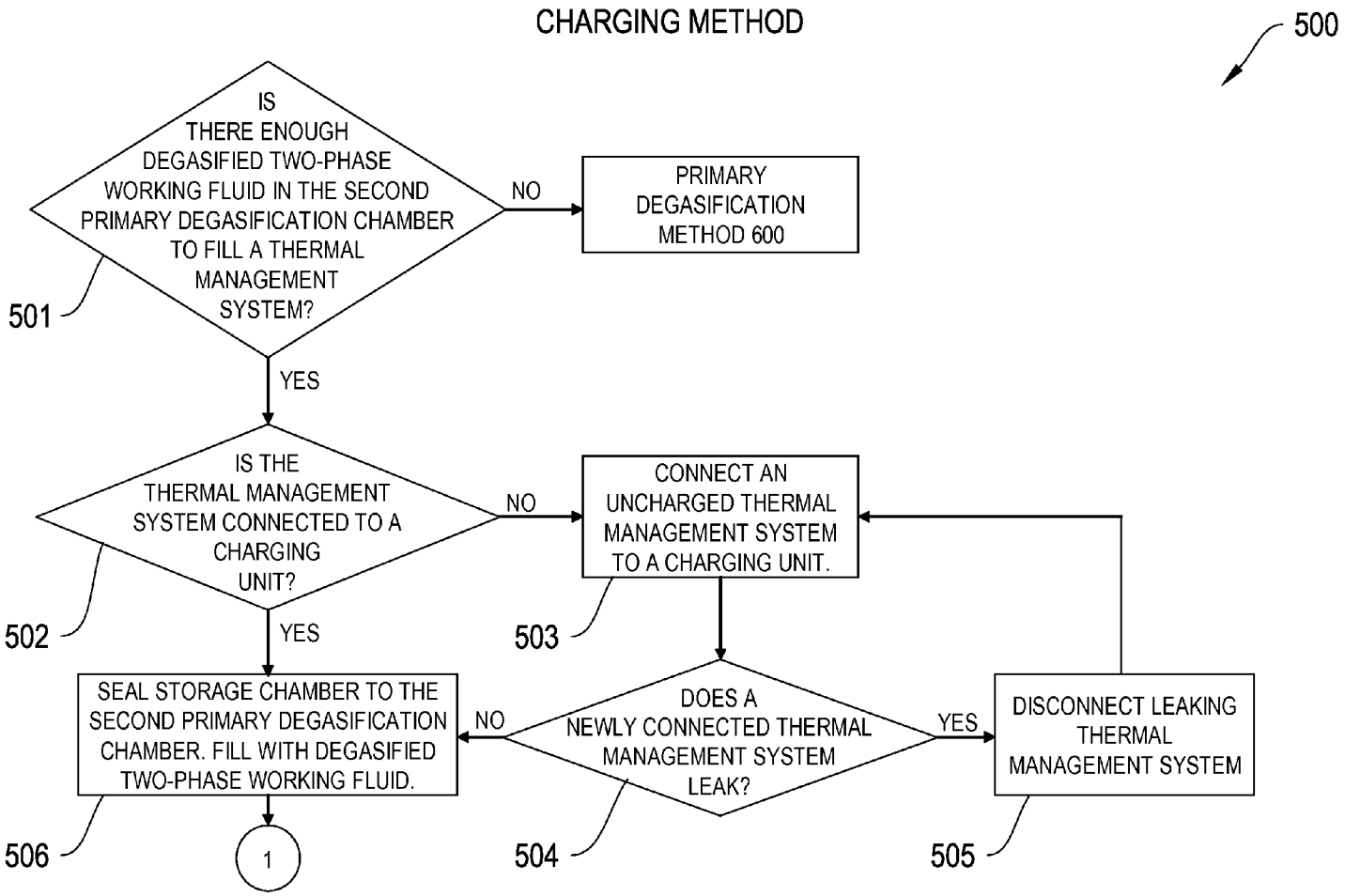
Fig. 5 (part 1)

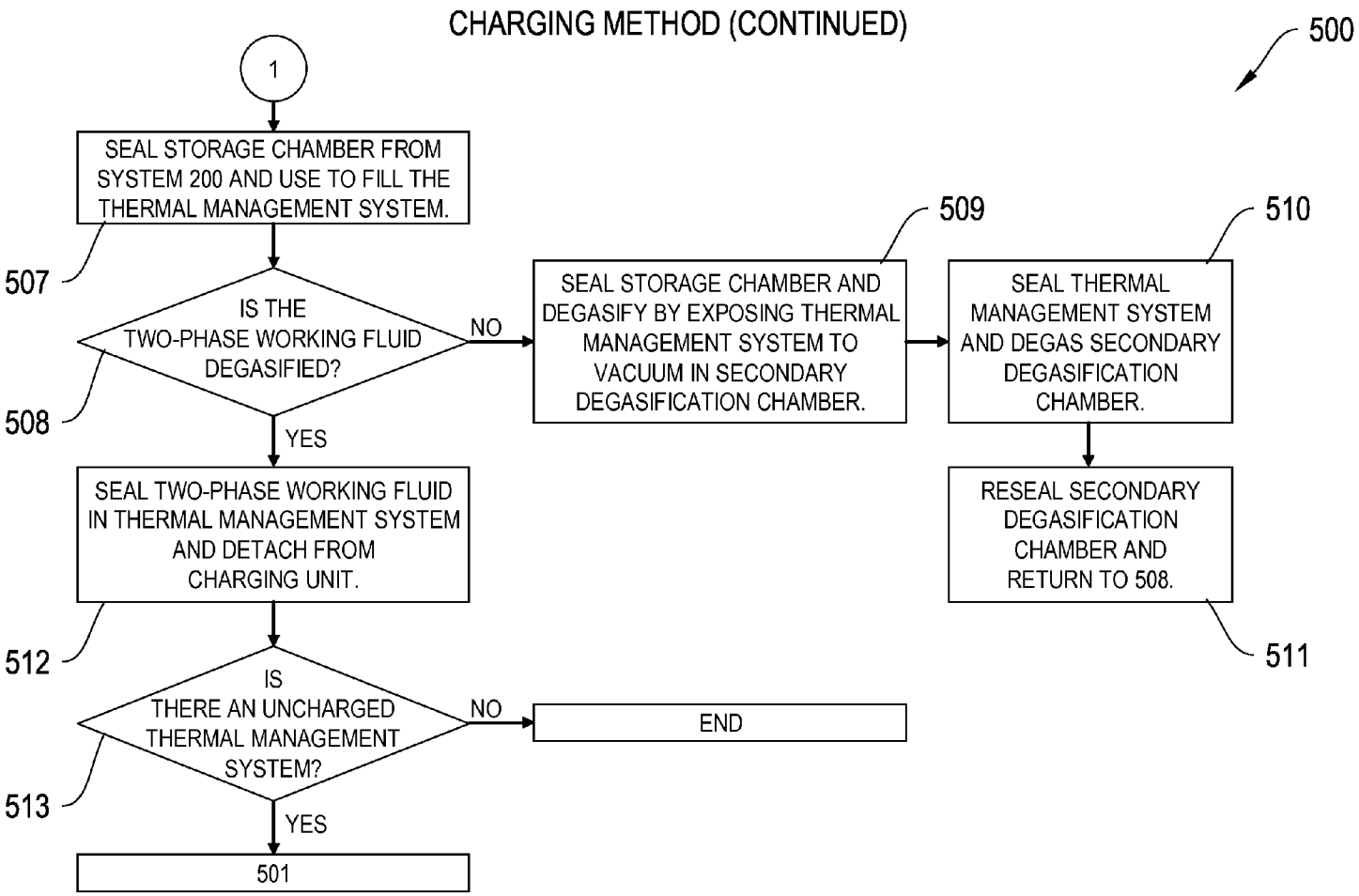
Fig. 5 (part 2)

VACUUM FILLING AND DEGASIFICATION SYSTEM

TECHNICAL FIELD

The systems and methods described herein relate to degasification, and particularly, to degasifying a two-phase working fluid for use in thermal management systems.

BACKGROUND

Modern computing systems can generate enough heat to damage their own components. A thermosiphon can keep computers from overheating by absorbing heat from one location and dissipating it at another. Thermosiphons use a two-phase working fluid—a fluid that will be in either the gas or liquid phases during operation—to operate without moving parts. The liquid phase of the two-phase working fluid evaporates as it absorbs heat; the gas phase of the two-phase working fluid diffuses to and thereby heats a colder region. In a thermosiphon, the gas phase of the two-phase working fluid condenses on and thereby heats cold thermosiphon walls (which, in turn, heat the surrounding environment), and the recondensed two-phase working fluid completes the cycle by flowing back to the hot end of the thermosiphon. But while the concept is simple, the fluid flow in thermal management systems on the scale of data centers is complicated.

As such, a method to improve the heat transfer characteristics of a two-phase working fluid would be of great benefit in the manufacture of thermal management systems.

SUMMARY

More specifically, the systems and methods described herein relate to improving thermal management systems, including but not limited to thermosiphons, that use a two-phase working fluid such as a refrigerant. It is a realization of the inventors that a non-condensable gas (NCG) may impair the function of a thermal management system. Under the operational conditions of a thermal management system, an NCG has a boiling point no higher than the lowest operational temperature of a thermal management system. NCGs like nitrogen or oxygen are soluble in common two-phase working fluids used to run thermal management systems. For example, under one atmosphere of pressure, air can make up 53% of the apparent volume of methoxy nonafluorobutane (3M Novec™ Engineered Fluid HFE-7100 for Heat Transfer), a refrigerant hydrofluorocarbon. But during operation of a thermal management system, such NCG often comes out of solution, forming insulating pockets that reduce the heat transfer rate of the thermal management system. Reducing or eliminating NCG from a thermal management system can improve the thermal management system performance, for example by a third in some systems. Consequently, a system to substantially purge NCG from a two-phase working fluid that will be used to charge (i.e., fill) thermal management systems would therefore be of great benefit in the manufacture of thermal management systems.

Accordingly, the systems and methods described herein relate to preparing a two-phase working fluid for charging a thermal management system by purging NCG from the two-phase working fluid. A two-phase working fluid is purged of NCG by separating the two-phase working fluid from dissolved NCG, a process known as degasification. By exposing the two-phase working fluid to conditions that cause an NCG to leave solution and venting that NCG, the heat transfer performance of a thermal management system charged with the degasified two-phase working fluid may be improved. The two-phase working fluid may include a refrigerant, and in such cases the refrigerant may include a hydrofluorocarbon.

In one implementation, the system includes a degasifier for purging an NCG from the liquid phase of the two-phase working fluid, a condenser for purging the gas phase of the two-phase working fluid by condensing the two-phase working fluid, an apparatus for controlling the flow of two-phase working fluid within the system, and a storage chamber for storing purged two-phase working fluid. As NCG may come out of solution in response to reduced pressure, heating, mechanical agitation, or some combination thereof, the degasifier may comprise a pump, a heater, a mechanical agitator, or some other suitable degasifier. In certain implementations, such a degasifier may be included in a pipe providing a fluid connection to the condenser. As the flow of two-phase working fluid within the system may be directed by a physical barrier or gradients of temperature and pressure, the apparatus for controlling the flow of two-phase working fluid within the system may comprise a valve, a pump, or a heater. In certain implementations, the storage chamber may be configured for measuring a volume of the two-phase working fluid used to charge the thermal management system.

In certain implementations, the system further includes a pump for removing gas from the system before use, preventing NCG contamination of two-phase working fluid within the system.

In certain implementations, the system further includes a charging unit for charging a thermal management system with the purged two-phase working fluid.

In certain implementations, the system further includes an isolation chamber for reducing a loss of two-phase working fluid from the system.

In certain implementations, the system further includes a leak detector for detecting a leak in the thermal management system.

In certain implementations, the two-phase working fluid inside the system may be kept at a higher pressure than the environment surrounding the system (i.e., a positive pressure) to reduce leakage of NCG into the degasification system.

According to another aspect, to the method prepares a two-phase working fluid for use in a thermal management system by purging the NCG from the liquid and gas phases of the two-phase working fluid and storing the purged two-phase working fluid. The liquid phase of the two-phase working fluid may be purged of NCG by heating the two-phase working fluid, exposing the two-phase working fluid to a reduced pressure, agitating the two-phase working fluid, or exposing the two-phase working fluid to some other condition appropriate for causing NCG to leave solution with the two-phase working fluid. The gas phase of the two-phase working fluid may be purged of NCG by condensing the gas phase of the two-phase working fluid, thereby causing the gas phase of the two-phase working fluid to leave a mixture of NCG and gaseous two-phase working fluid. In certain implementations, the method further comprises charging a thermal management system with the purged two-phase working fluid.

In certain implementations, the method further comprises purging a degasification system of NCG and providing the two-phase working fluid to the degasification system, thereby reducing contamination of two-phase working fluid by NCG. The degasification system may be purged of NCG by reducing a pressure in the degasification system. In certain further implementations, such contamination may be further reduced by maintaining the degasification system at a positive pressure to reduce leakage of NCG into the degasification system. In certain further implementations, the method may further comprise controlling fluid flow within the degasification system by applying a temperature gradient to the degasification system or by applying a pressure gradient to the degasification system.

In certain implementations, the method further comprises purging the thermal management system of the NCG.

In certain implementations, the method further comprises detecting a leak in the thermal management system.

BRIEF DESCRIPTION OF THE DRAWINGS

The systems and methods described herein are set forth in the appended claims. However, for the purpose of explanation and illustration, several implementations are set forth in the following figures.

FIG. 5 is a flow chart of a method for charging a thermosiphon with degasified two-phase working fluid;

DETAILED DESCRIPTION OF CERTAIN ILLUSTRATIVE IMPLEMENTATIONS

In the following description, numerous details are set forth for the purpose of explanation. However, one of ordinary skill in the art will realize that the implementations described herein may be practiced without the use of these specific details and that the implementations described herein may be modified, supplemented, or otherwise altered without departing from the scope of the invention.

The implementations described illustrate certain degasification systems and methods to degasify a two-phase working fluid. By exposing the liquid phase of the two-phase working fluid to conditions that cause NCG to come out of solution, the liquid phase of the two-phase working fluid may be substantially purged of NCG before being used to charge a thermal management system. By exposing the gas phase of the two-phase working fluid to conditions that will condense the two-phase working fluid but not the NCG, the gas phase of the two-phase working fluid may also be substantially purged of NCGs before being used to charge a thermal management system. Charging a server farm thermal management system with degasified two-phase working fluid improves the heat transfer performance of the thermal management system, allowing the server farm to be cooled more efficiently.

Figure 1:
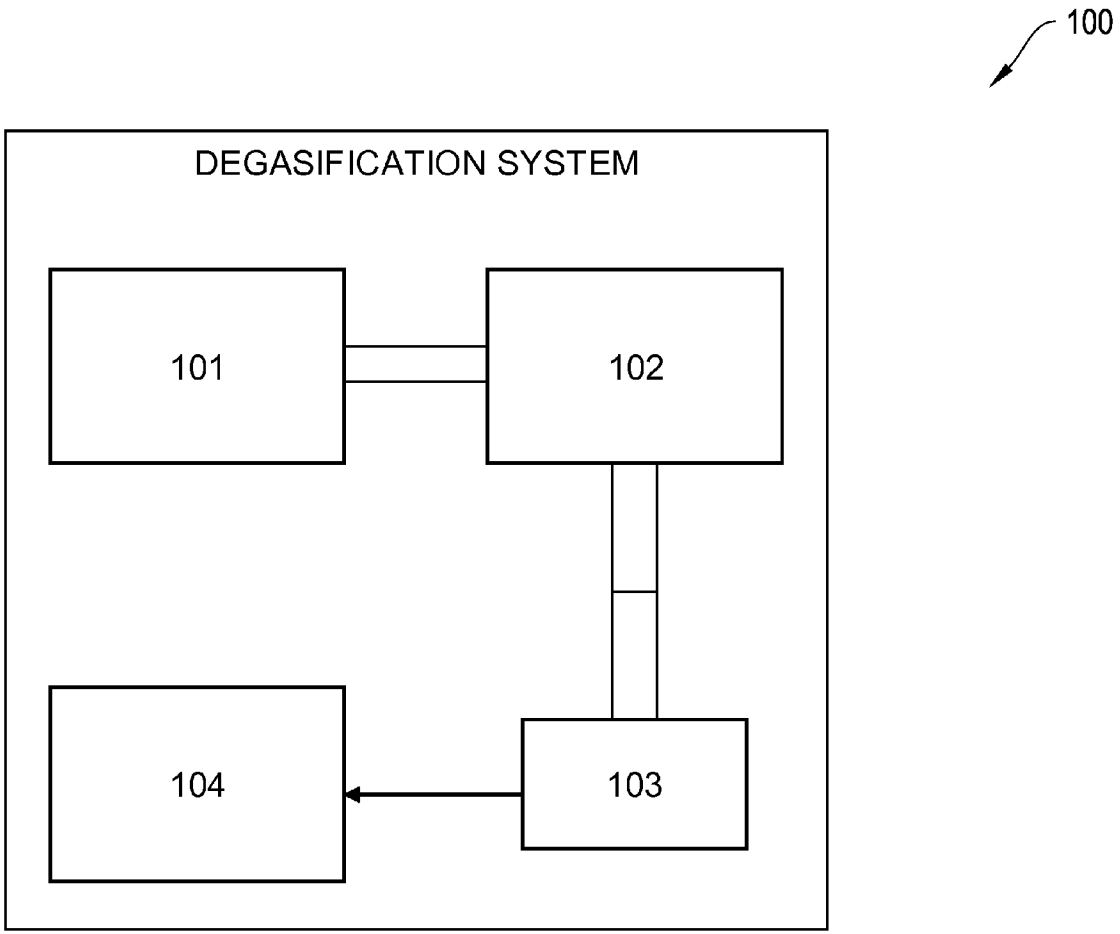
FIG. 1 is a block diagram of a two-phase working fluid degasification and charging system.

FIG. 1 is an illustrative diagram of one system 100 of the type described herein for charging a thermal management system with a two-phase working fluid, referred to herein as a degasification system 100. Degasification system 100 includes a primary degasification chamber 101, which degasifies two-phase working fluid, and filling chamber 102, which fills a thermal management system 103 with the degasified two-phase working fluid. Once filled, thermal management system 103 is sealed from the atmosphere and installed in location 104, which may include a server farm, a computer, a residence, or other appropriate location.

Figure 2:
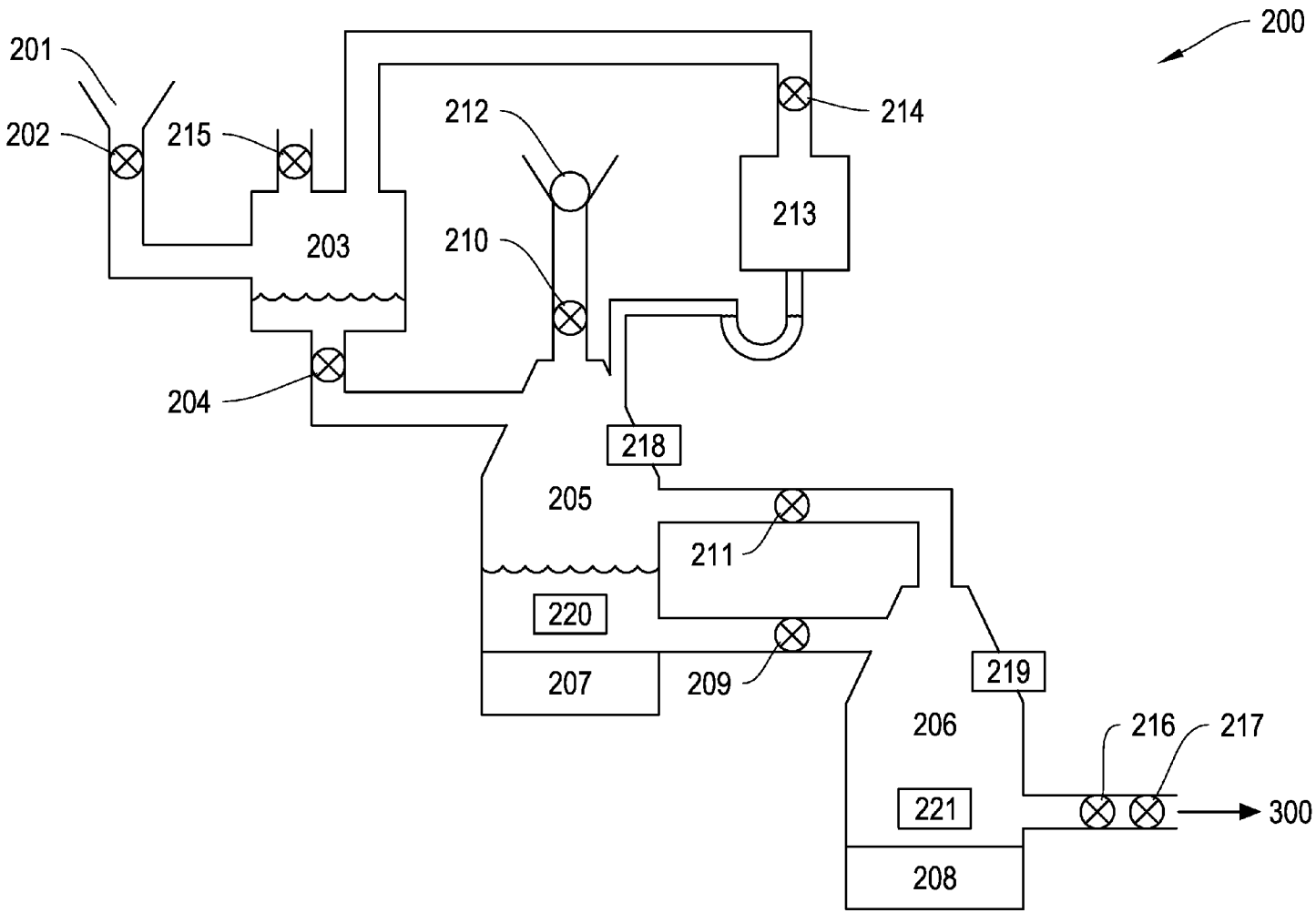
FIG. 2 is a block diagram of a two-phase working fluid primary degasification system.

FIG. 2 is an illustrative diagram of one system 200 of the type described herein for degasifying a two-phase working fluid, referred to herein as a primary degasification system 200. The primary degasification system 200 includes a chamber fill port 201 through which two-phase working fluid is provided; valves 202, 204, 209, 210, 211, 212, 214, 216, and 217, which partially comprise the fluid flow control system of the primary degasification system 200; isolation chamber 203, which reduces loss of two-phase working fluid from the system; primary degasification chambers 205 and 206, which hold the two-phase working fluid during degasification; heaters 207 and 208, which both degasify the two-phase working fluid and create thermal gradients to partially control fluid flow in the system; a condenser 213 which condenses the vapor phase of two-phase working fluid mixed with NCG, separating the two-phase working fluid from the NCG; temperature sensors 218 and 219, which determine the temperature in primary degasification chambers 205 and 206 respectively; and quantity sensors 220 and 221, which determine how much two-phase working fluid is in primary degasification chambers 205 and 206 respectively. The primary degasification system 200 is connected to a charging system 300 (not shown), which is explained in more detail below but includes a pump to perform an initial degassing operation on both primary degasification system 200 and charging system 300 and a storage chamber to store degasified two-phase working fluid.

The depicted chamber fill port 201 is a pipe that admits two-phase working fluid into primary degasification system 200. In certain implementations, chamber fill port 201 may be fitted with a valve that admits fluid provided through a predetermined nozzle shape.

The depicted valves 202, 204, 209, 210, 211, 214, 216, and 217 are valves which can switch between allowing and preventing fluid flow and can withstand a pressure differential of at least 150 psi, and may include ball valves, quarter turn plug valves, or other suitable valves. In certain implementations, valves 202, 204, 209, 210, 211, 214, 216, and 217 may be computer-controlled, and may be opened or closed in response to measurements from at least one of temperature sensors 218 and 219 and quantity sensors 220 and 221. Valve 202 allows or prevents fluid flow between chamber fill port 201 and isolation chamber 203; valve 204 between isolation chamber 203 and primary degasification chamber 205; valves 209 and 211 between primary degasification chamber 205 and primary degasification chamber 206; valve 210 between primary degasification chamber 205 and condenser 213; valve 214 between condenser 213 and isolation chamber 203; valve 215 between isolation chamber 203 and the environment; valve 216 between primary degasification chamber 206 and valve 217; and valve 217 between valve 216 and charging system 300.

The depicted isolation chamber 203 is a pressure vessel, a container which can withstand a predetermined pressure difference between the interior of the vessel and the surrounding atmosphere. Isolation chamber 203 stores NCG vented from condenser 213 before venting the NCG to the environment. Residual two-phase working fluid vapor that failed to condense in condenser 213 may condense in isolation chamber 203, reducing loss of two-phase working fluid mixed with NCG being vented. In certain implementations, isolation chamber 203 may promote the condensation of two-phase working fluid, including by maintaining an interior surface at a temperature below the boiling point of the two-phase working fluid or by some other suitable design.

The depicted primary degasification chambers 205 and 206 are pressure vessels which hold a predetermined quantity of two-phase working fluid, allow NCG to be purged from the two-phase working fluid, and do not recontaminate the two-phase working fluid with NCG. Primary degasification chambers 205 and 206 thus outgas below a predetermined rate and are capable of maintaining a predetermined pressure difference between the interior of the vessel and the surrounding atmosphere. As pressure vessels, primary degasification chambers 205 and 206 collect two-phase working fluid that may evaporate during a degasification process. In certain implementations, primary degasification chambers 205 and 206 include a degasifier, such as a pump, stirrer, shaker, or other suitable degasification devices that will cause NCG to come out of solution with two-phase working fluid. In certain implementations, the primary degasification chambers 205 and 206 have a feedthrough, not shown, that may allow external electrical power supply to the interior of a chamber or for a signal from temperature sensors 218 and 219 to be transmitted through a chamber wall.

The depicted heaters 207 and 208 are heaters which heat primary degasification chambers 205 and 206, respectively, to promote degasification of two-phase working fluid, and particularly the separation of NCG from the liquid phase of the two-phase working fluid. Heaters 207 and 208 therefore act as degasifiers. In certain implementations heaters 207 and 208 may include resistive heaters, Peltier stages, or other suitable heating elements, and may be computer-controlled. In certain implementations, a heater similar to heater 207 may promote degasification by heating a pipe, such as the pipe leading from valve 204 to primary degasification chamber 205.

The depicted valve 212 is a check valve or other suitable valve which prevents air from flowing into primary degasification system 200 but vents gas of a predetermined pressure from primary degasification system 200. Valve 212 reduces the likelihood of a dangerous pressure buildup within primary degasification system 200.

The depicted condenser 213 is a vessel which condenses two-phase working fluid vapor but not NCG, including by maintaining an interior surface at a temperature below the boiling point of the two-phase working fluid but above the boiling point of the NCG or by some other suitable conditions. Condenser 213 therefore degasifies two-phase working fluid which evaporates from the liquid phase of the two-phase working fluid in primary degasification chamber 205 and flows to condenser 213. Condenser 213 vents NCG to isolation chamber 213 and reintroduces the condensed two-phase working fluid to primary degasification chamber 205. Condensed two-phase working fluid flows from condenser 213 to primary degasification chamber 205 through a u-shaped tube, which uses a volume of condensed two-phase working fluid as a plug preventing vapor flow. In certain implementations, the cooled interior surface of condenser 213 may promote the flow of liquid two-phase working fluid into primary degasification chamber 205, including by promoting capillary action of liquid two-phase working fluid toward primary degasification chamber 205 or by some other suitable design. In certain implementations, condenser 213 may include a pump capable of ensuring unidirectional fluid flow from primary degasification chamber 205 into isolation chamber 203.

The depicted temperature sensors 218 and 219 are sensors suitable for determining the temperature in primary degasification chambers 205 and 206, respectively, and may be thermocouples, alcohol thermometers, infrared detectors, or other suitable temperature sensors. The temperature in primary degasification chambers 205 and 206 affects degasification of two-phase working fluid in primary degasification chambers 205 and 206, and may be used to control fluid flow within primary degasification system 200 and charging system 300. Consequently, in certain implementations temperature sensors 218 and 219 may provide signals to a computer controlling elements of primary degasification system 200 or charging system 300.

The depicted quantity sensors 220 and 221 are sensors suitable for determining the amount of two-phase working fluid in primary degasification chambers 205 and 206 respectively, and may include sight glass, weight sensors, pressure sensors, flow sensors, or other suitable sensors. The amount of two-phase working fluid in primary degasification chambers 205 and 206 indicates when a chamber may be degasified and whether it can supply degasified two-phase working fluid. In certain implementations, quantity sensors 214 and 215 may provide signals to a computer controlling elements of primary degasification system 200 or charging system 300.

The depicted primary degasification system 200 degasifies two-phase working fluid through distillation. Primary degasification system 200 is first degassed by the pump in charging system 300, preventing NCG within primary degasification system 200 from contaminating two-phase working fluid. Once primary degasification system 200 has been degassed, valve 202 controls the provision of two-phase working fluid to primary degasification system 200 via chamber fill port 201. The two-phase working fluid fills primary degasification chamber 205 to a predetermined level measured by quantity sensor 220. Primary degasification chamber 205 is heated by heater 207 to a predetermined temperature measured by temperature sensor 218. The heat causes NCG to come out of solution, allowing the NCG to vent through valve 210. The vapor vents through condenser 213, which recovers evaporated two-phase working fluid. NCG vents to isolation chamber 203, while the recovered two-phase working fluid is restored to primary degasification chamber 205. Opening valve 209 allows primary degasification chamber 205 to provide degasified two-phase working fluid to primary degasification chamber 206; closing valves 209 and 211 allow primary degasification chamber 206 to supply degasified two-phase working fluid to a thermal management system while more two-phase working fluid is degasified in primary degasification chamber 205.

In one implementation, two-phase working fluid is moved between elements of the primary degasification system 200 by creating a thermal gradient between the location of the two-phase working fluid and the destination of the two-phase working fluid. The pressure of a fluid is coupled to the temperature of the fluid, so fluid will flow from regions of higher temperature to regions of lower temperature. As an illustrative example, maintaining primary degasification chamber 205 at a higher temperature than primary degasification chamber 206 will cause fluid to flow from primary degasification chamber 205 to primary degasification chamber 206. In certain implementations, two-phase working fluid may be moved by other suitable methods, such as by pumping.

Figure 3:
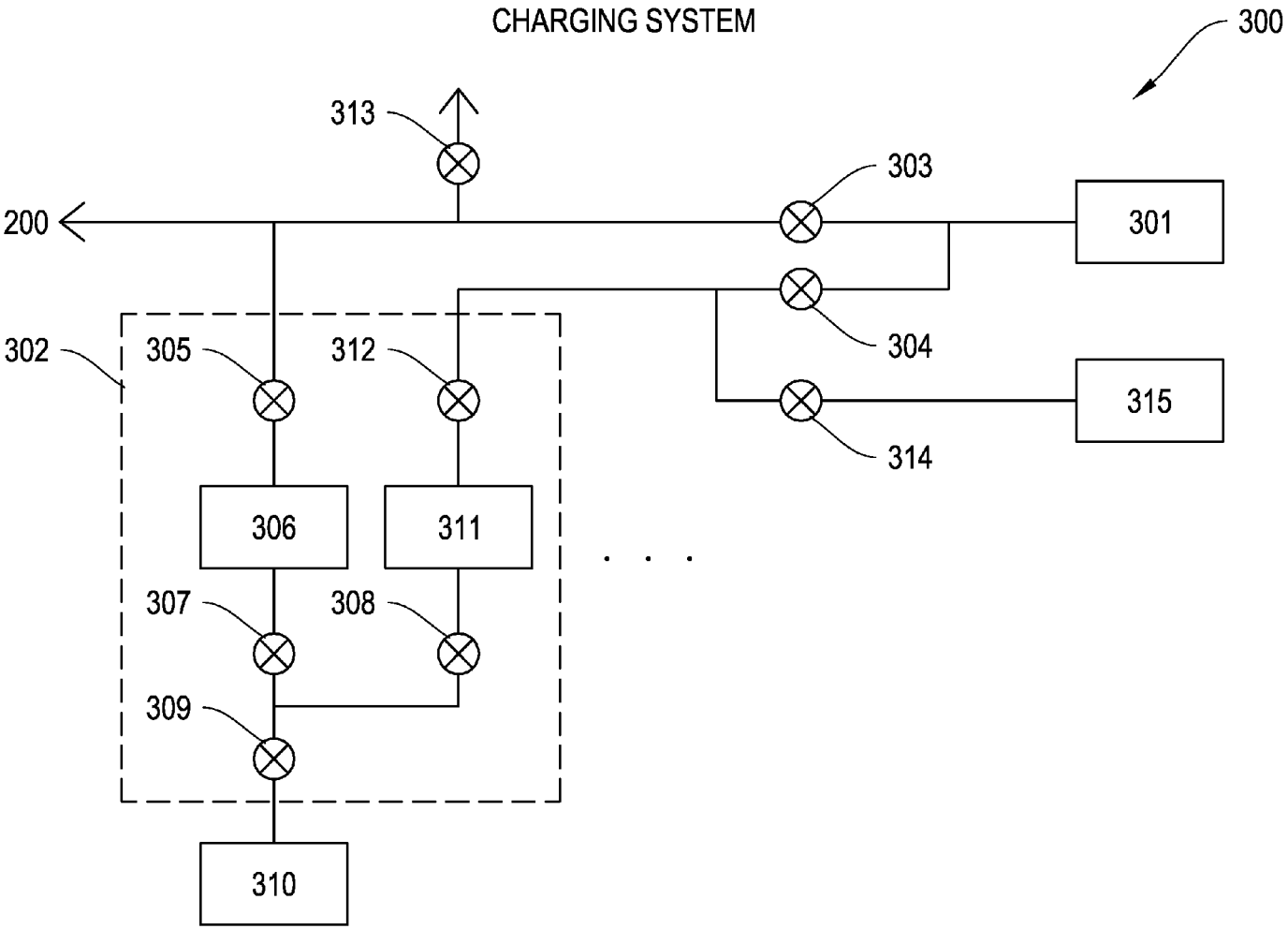
FIG. 3 is a block diagram of a secondary degasification and thermosiphon charging system.

FIG. 3 is a diagram of a charging system 300 for filling a thermal management system with a predetermined amount of degasified two-phase working fluid. The depicted charging system 300 is connected to primary degasification system 200, and includes a pump 301 to create pressure gradients in and remove contaminating NCG from both the charging system 300 and the primary degasification system 200; a charging unit 302 to charge a thermal management system 310 with degasified two-phase working fluid; valves 303, 304, 313, and 314, which partially comprise the fluid control system of charging system 300; and a leak detector 315 to detect leaks in a part or a whole of degasification system 200, charging system 300, and a thermal management system 310. A charging unit 302 includes valves 305, 307, 308, 309, and 312, which partially comprise the fluid control system of the charging unit 302; a storage chamber 306, which stores degasified two-phase working fluid; and a secondary degasification chamber 311, used for secondary degasification of two-phase working fluid. A charging unit 302 is connected to a thermal management system 310 in order to degas and charge the thermal management system 310. In certain implementations, charging system 300 may include sensors, such as temperature sensors, pressure sensors, weight sensors, sight glasses, or other appropriate sensors, to provide information regarding the state of elements of charging system 300 or thermal management system 310. In certain implementations, sensors may provide input to a computer controlling charging system 300.

The depicted pump 301 is a pump in fluid communication with charging system 300 and capable of reducing the pressure within both charging system 300 and primary degasification system 200 to a predetermined pressure, and may include a rotary vane pump, a scroll pump, or other suitable pump. By reducing the pressure, pump 301 reduces the amount of NCG adhering to the interior surfaces of charging system 300 and primary degasification system 200, preventing such NCG from contaminating two-phase working fluid. Pump 301 also creates pressure gradients within charging system 300 and primary degasification system 200, which cause two-phase working fluid to move from areas of high pressure to areas of low pressure. Pump 301 may also be used to further degasify a two-phase working fluid.

The depicted valves 303, 304, 305, 307, 308, 309, 312, 313, and 314 are valves which can switch between allowing and preventing fluid flow and withstand a pressure of at least 150 psi, and may include ball valves, quarter turn plug valves, or other suitable valves. In certain implementations, valves 303, 304, 305, 307, 308, 309, 312, 313, and 314 may be computer-controlled, and may be opened or closed in response to measurements from at least one of quantity sensors 214 and 215 and temperature sensors 216 and 217. Valves 303 and 304 control fluid flow to pump 301, valve 303 from primary degasification system 200 and pipes from storage chamber 306, valve 304 from pipes leading to secondary degasification chamber 311. Valve 305 controls fluid flow between secondary degasification chamber 200 and storage chamber 306; valve 307 controls fluid flow from storage chamber 306; valve 308 controls fluid flow into secondary degasification chamber 311; valve 309 controls fluid flow into thermal management system 310; and valve 312 controls fluid flow between secondary degasification chamber 311 and valve 304. Valve 313 controls fluid flow between charging system 300 and the atmosphere, and is used if the system needs to be vented for maintenance. Valve 314 controls fluid flow from charging unit 302 to leak detector 315.

The depicted storage chamber 306 is a vessel which holds the predetermined volume of degasified two-phase working fluid required to charge a thermal management system 310. Storage chamber 306 is filled with degasified two-phase working fluid by primary degasification system 200. To prevent recontamination of the degasified two-phase working fluid, pump 301 degasses storage chamber 306, so storage chamber 306 outgasses below a predetermined rate and is capable of maintaining a predetermined pressure difference between the interior of the vessel and the surrounding atmosphere. In certain implementations, the depicted storage chamber 306 includes a sensor suitable for indicating the amount of two-phase working fluid in storage chamber 306, such as a liquid-level gauge. Storage chamber 306 may also be provided with a temperature control system to partially control fluid flow into and out of storage chamber 306.

The depicted thermal management system 310 is a thermosiphon, heat pipe, or other thermal management system reliant on a two-phase working fluid. A thermal management system 310 is temporarily attached to a charging unit 302: once degassed by pump 301 and filled with degasified two-phase working fluid by a charging unit 302, thermal management system 310 is closed with a gas-tight seal by crimping or another suitable method. In certain implementations, the depicted thermal management system 310 may be provided with a sensor to confirm that it has been charged with the appropriate quantity of degasified two-phase working fluid. Thermal management system 310 may also be cooled to partially control fluid flow into and out of thermal management system 310.

The depicted secondary degasification chamber 311 is a pressure vessel used for vacuum degasification of a two-phase working fluid, and thus outgasses below a predetermined rate and is capable of maintaining a predetermined pressure difference between the interior of the vessel and the surrounding atmosphere. Secondary degasification chamber 311 is evacuated by pump 301, and the resulting vacuum is maintained by closing valves 308 and 312. Opening valve 308 will expose a two-phase working fluid to the vacuum in secondary degasification chamber 311, thereby vacuum degasifying the two-phase working fluid. In certain implementations, secondary degasification chamber 311 is used to degasify a two-phase working fluid in response to a sensor indicating that the two-phase working fluid has not been sufficiently degasified.

The depicted leak detector 315 detects a leak within primary degasification system 200, charging system 300, or thermal management system 310, and may include a helium mass spectrometer or other suitable leak detector. By immersing a part or a whole of primary degasification system 200, charging system 300, and thermal management system 310 in a tracer gas such as helium, leak detector 315 can determine if a part is cracked or otherwise improperly sealed: if tracer gas is detected at leak detector 315, some part is leaking. In certain implementations, a thermal management system 310 may be tested for leaks prior to being charged.

In certain implementations, a storage chamber 306 is filled with degasified two-phase working fluid from primary degasification chamber 205, thereby measuring the quantity of degasified two-phase working fluid required to charge a thermal management system 310. The thermal management system 310 is then charged with degasified two-phase working fluid from storage chamber 306. The two-phase working fluid in thermal management system 310 may be further degasified by exposure to vacuum in secondary degasification chamber 311. The charging system 300 may include more than one charging unit 302, thereby allowing more than one thermal management system 310 to be charged with degasified two-phase working fluid at the same time. In certain implementations, a first charging unit 302 may operate independently of a second charging unit 302.

Figure 4:
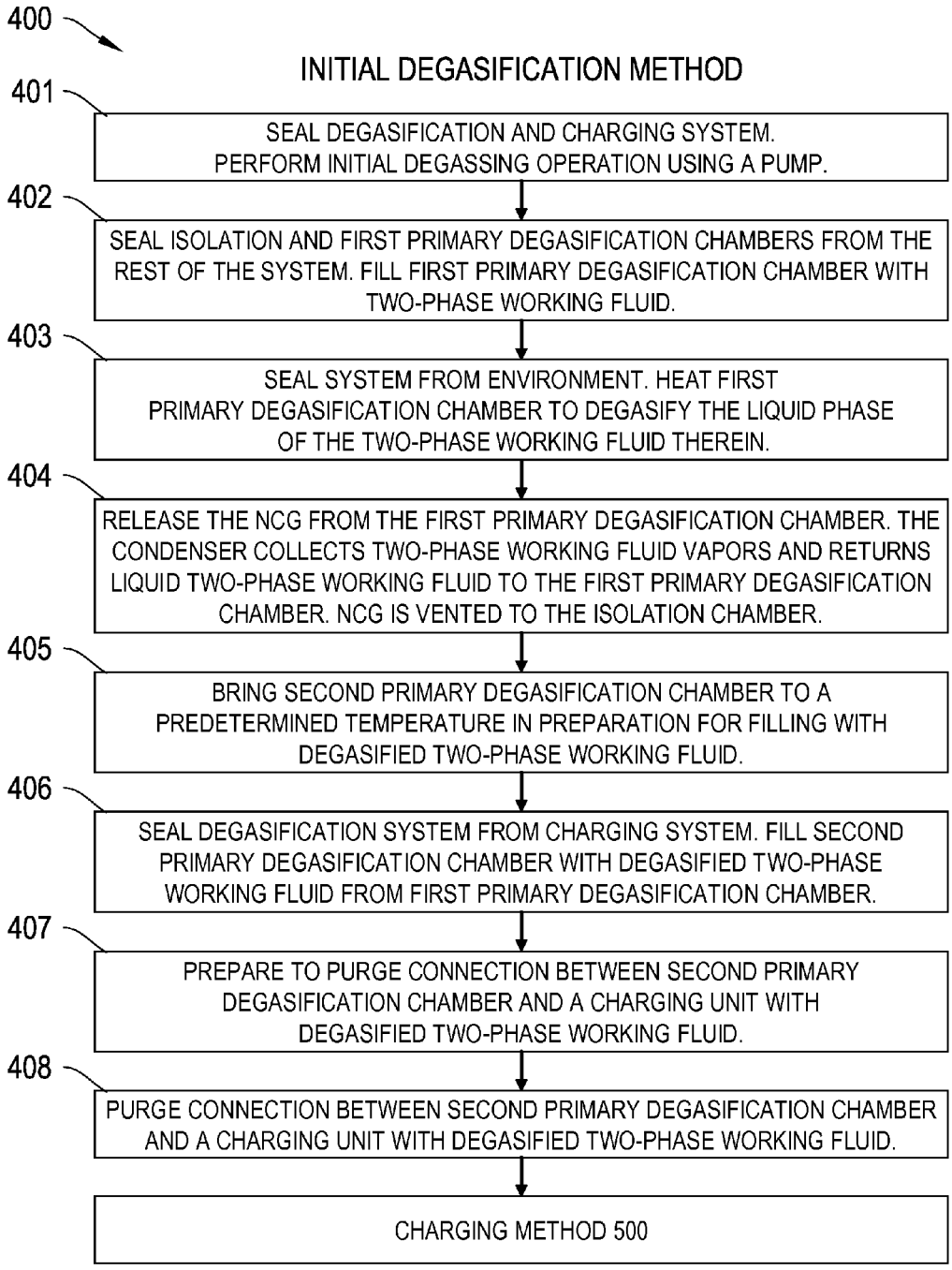
FIG. 4 is a flow chart of a method for initial degasification of a two-phase working fluid.

FIG. 4 is an illustrative flow chart of a method 400 for an initial degasification of a two-phase working fluid, referred to herein as initial degasification method 400. Referring to FIGS. 2 and 3, initial degasification method 400 begins by preparing the system for degasification. Step 401 performs an initial degassing operation on primary degasification system 200 and charging system 300 with pump 301 by closing valves 202, 215, 309, 313, and 314, and opening all other valves. Step 402 charges primary degasification system 200 by closing valves 209, 210, 211, 214, and 216, opening valve 202, and providing two-phase working fluid through chamber fill port 201. Quantity sensor 220 indicates when a predetermined quantity of two-phase working fluid has been provided.

Initial degasification method 400 then degasifies the two-phase working fluid in primary degasification chamber 205. Step 403 closes valve 202 and uses heater 207 to raise primary degasification chamber 205 to a predetermined temperature. After a predetermined time, step 404 opens valves 210 and 214, venting the NCG that heat has caused to come out of solution. Gas vented from primary degasification chamber 205 through valve 210 passes through condenser 213, which condenses two-phase working fluid that may have evaporated during degasification. Liquid two-phase working fluid is returned to primary degasification chamber 205 from condenser 213, while NCG travels to isolation chamber 203, from which it will subsequently be vented from primary degasification system 200.

Degasification method 400 then stores degasified two-phase working fluid in preparation for charging a thermal management system 310. Step 405 brings primary degasification chamber 206 to a predetermined temperature in preparation for being filled with degasified two-phase working fluid from primary degasification chamber 205. Step 406 closes valves 217 and opens valves 209 and 216, filling primary degasification chamber 206 with degasified two-phase working fluid. Step 407 closes valve 216, leaving the space between valves 216 and 217 filled with a limited volume of degasified two-phase working fluid that will be used for purging the connection between primary degasification chamber 206 and charging unit 302. Step 408 closes valves 304 and 305 and opens valves 217 and 303, thereby purging the connection between primary degasification chamber 206 and charging unit 302 of remaining NCG. Primary degasification system 200 and charging system 300 are then prepared to begin charging method 500, described below.

FIG. 5 is an illustrative flow chart of charging method 500, a method for semi-continuously charging a thermal management system with degasified two-phase working fluid. In certain implementations charging method 500 may be applied concurrently and independently to charge more than one thermal management system. Referring to FIGS. 2 and 3, charging method 500 begins by determining if primary degasification system 200 and charging system 300 are prepared to charge a thermal management system 310. Step 501 uses quantity sensor 221 to determine if primary degasification chamber 206 contains sufficient degasified two-phase working fluid to fill a thermal management system 310. If not, primary degasification method 600, described below, refills primary degasification chamber 206 with degasified two-phase working fluid. If so, step 502 determines if a thermal management system 310 is connected to a charging unit 302. If not, step 503 connects a thermal management system 310 to a charging unit 302. Step 504 uses leak detector 315 to determine whether a newly connected thermal management system 310 leaks, and, if so, step 505 disconnects and discards the leaking thermal management system 310 before returning to step 503. If an acceptable, uncharged thermal management system 310 is connected to a charging unit 302, step 506 closes valves 303 and 307 and opens valves 216, 304, 305, and 309. Step 506 thereby fills a storage chamber 306 with degasified two-phase working fluid from primary degasification chamber 205 while degassing the thermal management system 310.

Charging method 500 then charges the thermal management system 310. Step 507 closes valves 216, 305, and 308 and opens valve 307, in some implementations in response to a sensor indication that storage chamber 306 contains a predetermined amount of two-phase working fluid. Step 507 thereby charges the thermal management system 310. Step 508 determines whether the two-phase working fluid is sufficiently degasified, including by determining whether the two-phase working fluid has undergone a predetermined number of secondary degasifications, through measuring the heat transfer characteristics of the thermal management system 310, or through some other suitable method. If not, step 509 closes valves 307 and 312 and opens valve 308, exposing the two-phase working fluid to a vacuum in secondary degasification chamber 311, further degasifying the two-phase working fluid. Step 510 closes valve 309 and opens valve 312, restoring the vacuum in secondary degasification chamber 311. Step 511 closes valves 308 and 312, readying secondary degasification chamber 311 for further use, and charging method 500 returns to step 508. If step 508 determines that the two-phase working fluid is sufficiently degasified, step 512 closes valve 309 and seals thermal management system 310, which is now charged and ready for use. Step 513 then determines if an uncharged thermal management system 310 remains. If not, charging method 500 is complete; if so, charging method 500 begins again.

Figure 6:
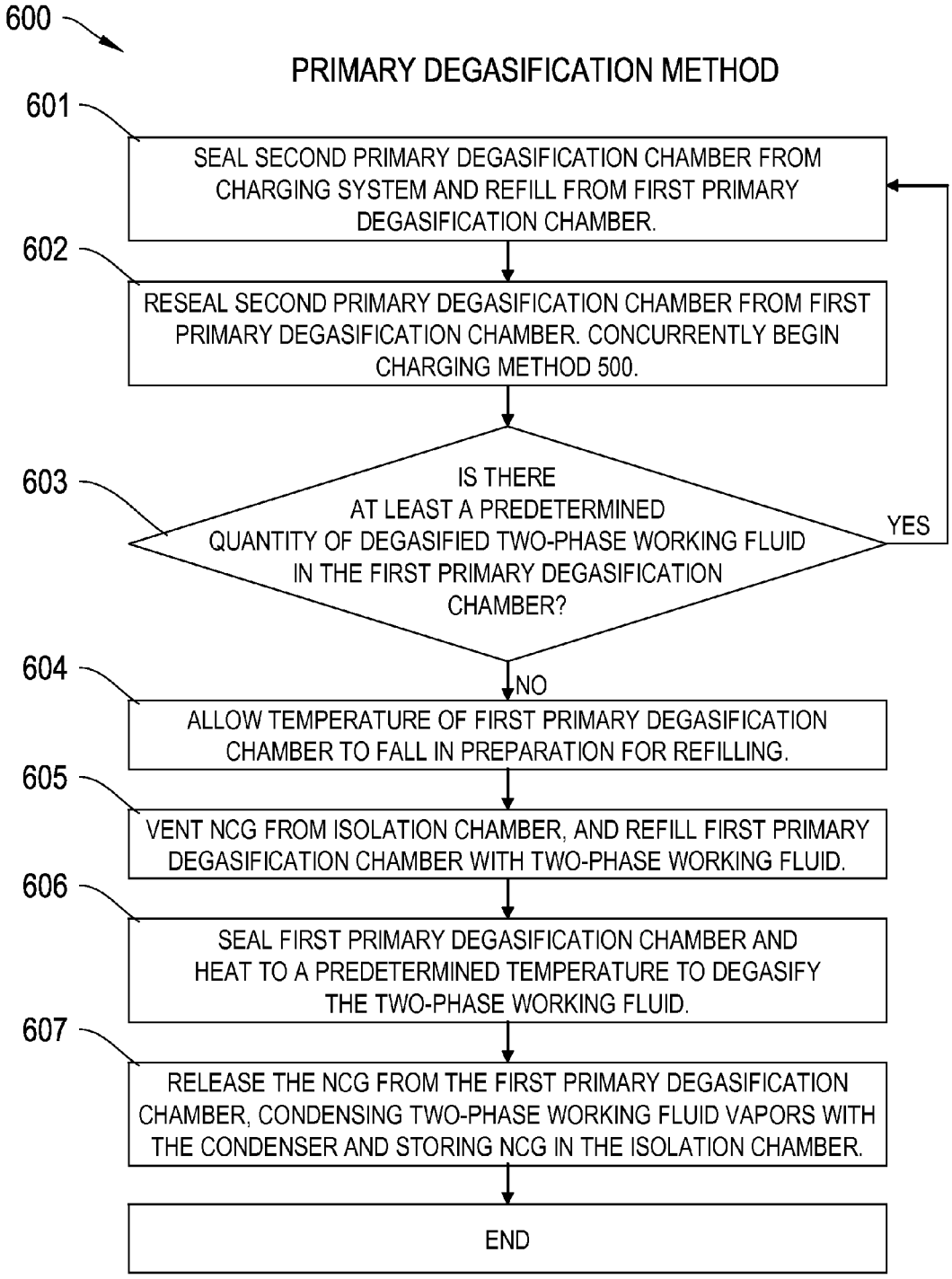
FIG. 6 is a flow chart of a method for semicontinuous degasification of a two-phase working fluid.

FIG. 6 is an illustrative flow chart of primary degasification method 600, a method for degasifying two-phase working fluid while charging system 300 is charging a thermal management system. Referring to FIGS. 2 and 3, when quantity sensor 221 indicates that primary degasification chamber 206 has less than a predetermined quantity of degasified two-phase working fluid, step 601 closes valve 216 and opens valve 209, recharging primary degasification chamber 206 from primary degasification chamber 205. Step 602 then closes valve 209 and concurrently begins charging method 500. In step 603, quantity sensor 220 indicates whether primary degasification chamber 205 contains at least a predetermined quantity of degasified two-phase working fluid. If so, primary degasification method 600 ends; if not, step 604 reduces the temperature of primary degasification chamber 205 to a predetermined level, preparing primary degasification system 200 for refilling. Step 605 opens valves 202, 204, 210, and 215, allowing NCG to vent from isolation chamber 203 while providing two-phase working fluid through chamber fill port 201. Step 606 then closes valves 202, 210, and 215 and heats primary degasification chamber 205 to a predetermined temperature. The heat causes NCG to come out of solution with the two-phase working fluid, allowing step 607 to vent the NCG to isolation chamber 203 by opening valves 210 and 214. As primary degasification chamber 203 once again contains degasified two-phase working fluid, primary degasification method 600 ends.

Figure 7:
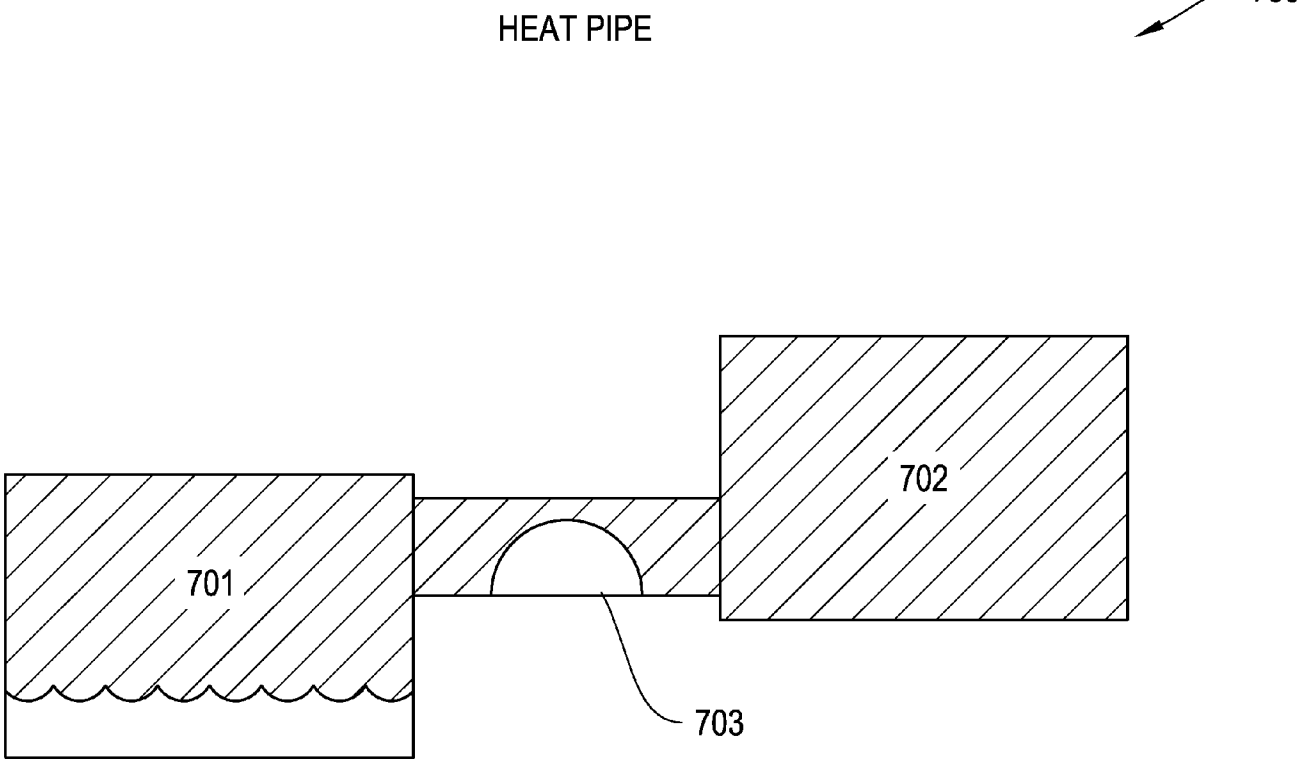
FIG. 7 is a diagram of a thermosiphon filled with two-phase working fluid contaminated with non-condensable gas.

FIG. 7 is an illustration of a thermal management system filled with insufficiently degasified two-phase working fluid, referred to herein as thermosiphon 700. Thermosiphon 700 includes an evaporator 701 and a condenser 702, and is filled with two-phase working fluid. Evaporator 701 contains liquid two-phase working solution that cannot become hotter than the two-phase working fluid boiling point; gaseous two-phase working fluid heats the walls of condenser 702 by condensing on them. Thus heat is transferred from the cool surface of evaporator 701 to the warm surface of condenser 702, and from there to the surrounding environment. But condenser 702 is not dissipating heat to the environment as efficiently as possible. NCG bubble 703 reduces the rate at which two-phase working fluid circulates in thermosiphon 700, thereby reducing the heat transfer rate of thermosiphon 700.

While various implementations of the present disclosure have been shown and described herein, it will be obvious to those skilled in the art that such implementations are provided by way of example only. Numerous variations, changes, and substitutions will now occur to those skilled in the art without departing from the disclosure. For example, a different number of degasification chambers may be used, or a vacuum pump may be used for degasifying the two-phase working fluid. It should be understood that various alternatives to the implementations of the disclosure described herein may be employed in practicing the disclosure. It is intended that the following claims define the scope of the disclosure and that methods and structures within the scope of these claims and their equivalents be covered thereby.

We claim:

1. A method of preparing a two-phase working fluid for use in a thermal management system, the two-phase working fluid having a liquid phase and a gas phase, comprising:

purging a non-condensable gas from the liquid phase of the two-phase working fluid;

purging the non-condensable gas from the gas phase of the two-phase working fluid by condensing the gas phase of the two-phase working fluid;

purging the thermal management system of the non-condensable gas; and storing the purged two-phase working fluid.

2. The method of claim 1, further comprising purging a degasification system of the non-condensable gas and providing the two-phase working fluid to the degasification system.

3. The method of claim 2, further comprising reducing a pressure in the degasification system to purge the degasification system of the non-condensable gas.

4. The method of claim 2, further comprising applying a temperature gradient to the degasification system to control fluid flow within the degasification system.

5. The method of claim 2, further comprising applying a pressure gradient to the degasification system to control fluid flow within the degasification system.

6. The method of claim 2, further comprising maintaining the degasification system at a positive pressure to reduce leakage of the non-condensable gas into the degasification system.

7. The method of claim 1, further comprising charging a thermal management system with the purged two-phase working fluid.

8. The method of claim 1, wherein purging the non-condensable gas from the liquid phase of the two-phase working fluid includes heating the two-phase working fluid.

9. The method of claim 1, wherein purging the non-condensable gas from the liquid phase of the two-phase working fluid includes reducing a pressure in a degasification system.

10. The method of claim 1, wherein purging the non-condensable gas from the liquid phase of the two-phase working fluid includes agitating the liquid phase of the two-phase working fluid.

11. The method of claim 1, further comprising detecting a leak in the thermal management system.

12. The method of claim 1, wherein the two-phase working fluid includes a refrigerant.

13. The method of claim 12, wherein the refrigerant includes a hydrofluorocarbon.

14. A system for preparing a two-phase working fluid for charging a thermal management system, the two-phase working fluid having a liquid phase and a gas phase, comprising:

a degasifier for purging a non-condensable gas from the liquid phase of the two-phase working fluid;

a condenser for purging the gas phase of the two-phase working fluid by condensing the two-phase working fluid;

a pump for purging the system of the non-condensable gas;

an apparatus for controlling the flow of two-phase working fluid within the system; and a storage chamber for storing purged two-phase working fluid.

15. The system of claim 14, further comprising a pipe providing a fluid connection to the condenser, the pipe including a degasifier.

16. The system of claim 14, further comprising a charging unit for charging a thermal management system with the purged two-phase working fluid.

17. The system of claim 14, wherein the storage chamber is further configured for measuring a volume of the two-phase working fluid used to charge the thermal management system.

18. The system of claim 14, further comprising an isolation chamber for reducing a loss of two-phase working fluid from the system.

19. The system of claim 14, further comprising a leak detector for detecting a leak in the thermal management system.

20. The system of claim 14, wherein the degasifier comprises a heater.

21. The system of claim 14, wherein the degasifier comprises a pump.

22. The system of claim 14, wherein the degasifier comprises a mechanical agitator.

23. The system of claim 14, wherein the apparatus for controlling the flow of two-phase working fluid within the system comprises a valve.

24. The system of claim 14, wherein the apparatus for controlling the flow of two-phase working fluid within the system comprises a pump.

25. The system of claim 14, wherein the apparatus for controlling the flow of two-phase working fluid within the system comprises a heater.

26. A method of preparing a two-phase working fluid for use in a thermal management system, the two-phase working fluid having a liquid phase and a gas phase, comprising:

purging a non-condensable gas from the liquid phase of the two-phase working fluid;

purging the non-condensable gas from the gas phase of the two-phase working fluid by condensing the gas phase of the two-phase working fluid;

purging a degasification system of the non-condensable gas and providing the two-phase working fluid to the degasification system;

applying at least one of a temperature gradient or a pressure gradient to the degasification system to control fluid flow within the degasification system; and storing the purged two-phase working fluid.

27. A method of preparing a two-phase working fluid for use in a thermal management system, the two-phase working fluid having a liquid phase and a gas phase, comprising:

purging a non-condensable gas from the liquid phase of the two-phase working fluid;

purging the non-condensable gas from the gas phase of the two-phase working fluid by condensing the gas phase of the two-phase working fluid;

purging a degasification system of the non-condensable gas and providing the two-phase working fluid to the degasification system;

maintaining the degasification system at a positive pressure to reduce leakage of the non-condensable gas into the degasification system; and storing the purged two-phase working fluid.

28. A method of preparing a two-phase working fluid for use in a thermal management system, the two-phase working fluid having a liquid phase and a gas phase, comprising:

purging a non-condensable gas from the liquid phase of the two-phase working fluid, where the purging comprises at least one of:

heating the two-phase working fluid;

reducing a pressure in a degasification system; or agitating the liquid phase of the two-phase working fluid; purging the degasification system of the non-condensable gas and providing the two-phase working fluid to the degasification system;

purging the non-condensable gas from the gas phase of the two-phase working fluid by condensing the gas phase of the two-phase working fluid; and storing the purged two-phase working fluid.

29. A system for preparing a two-phase working fluid for charging a thermal management system, the two-phase working fluid having a liquid phase and a gas phase, comprising:

a degasifier for purging a non-condensable gas from the liquid phase of the two-phase working fluid;

a condenser for purging the gas phase of the two-phase working fluid by condensing the two-phase working fluid;

an apparatus for controlling the flow of two-phase working fluid within the system;

an isolation chamber for reducing a loss of two-phase working fluid from the system; and a storage chamber for storing purged two-phase working fluid.

30. A system for preparing a two-phase working fluid for charging a thermal management system, the two-phase working fluid having a liquid phase and a gas phase, comprising:

a degasifier for purging a non-condensable gas from the liquid phase of the two-phase working fluid, the degasifier comprising at least one of a heater, a pump, or a mechanical agitator;

a condenser for purging the gas phase of the two-phase working fluid by condensing the two-phase working fluid;

an apparatus for controlling the flow of two-phase working fluid within the system; and a storage chamber for storing purged two-phase working fluid.

* * * * *